United States Patent [19]

Evans

[11] Patent Number: 4,638,317

[45] Date of Patent: Jan. 20, 1987

[54] ORTHOGONAL BEAM FORMING NETWORK

[75] Inventor: Gary E. Evans, Trappe, Md.

[73] Assignee: Westinghouse Electric Corp., Pittsburgh, Pa.

[21] Appl. No.: 622,300

[22] Filed: Jun. 19, 1984

[51] Int. Cl.[4] ..... H01Q 03/40

[52] U.S. Cl. ..... 342/373; 342/368

[58] Field of Search ..... 343/368, 373, 371, 376, 343/754

[56] References Cited

U.S. PATENT DOCUMENTS

| | | | |
|---|---|---|---|
| 3,255,450 | 6/1966 | Butler | 343/373 |
| 3,295,134 | 12/1966 | Lowe | 343/373 |
| 4,028,710 | 6/1977 | Evans | 343/373 |
| 4,231,040 | 10/1980 | Walker | 343/373 |

*Primary Examiner*—Theodore M. Blum
*Assistant Examiner*—Mark Hellner
*Attorney, Agent, or Firm*—W. G. Sutcliff

[57] ABSTRACT

A binary Butler matrix is expanded into a non-binary matrix coupled to a like number of non-binary antenna elements for forming multiple beams from a phased array and wherein an n×n Butler matrix drives n+1 elements, and where the 1 elements are coupled to predetermined ports of the Butler matrix normally coupled to the n elements but coupled thereto through respective 180° phase shifters such that, for example, the first or $(n+1)_{th}$ element to the right of the $n_{th}$ element is coupled to the same port of the Butler matrix coupled to the 1st element but additionally through a fixed 180° phase shifter while the first or $0_{th}$ element to the left of the 1st element is coupled to the $n_{th}$ same port coupled to the $n_{th}$ element but including a respective 180° phase shifter. Progressively increasing numbers of elements on either side of the n elements are respectively coupled to ascending and descending numbered ports of the binary matrix through respective 180° phase shifters, the result being an amplitude taper of the composite beams formed thereby.

20 Claims, 4 Drawing Figures

ORTHOGONAL BEAM FORMING NETWORK

BACKGROUND OF THE INVENTION

1. Field of the Invention

This invention relates generally to phased array antenna systems and more particularly to an improved beam forming matrix for forming a plurality of orthogonal beams.

2. Description of the Prior Art

Electrically scanned antennas are generally well known and comprise an antenna system including a plurality of radiating elements which are fixed in space and wherein one or more RF beams are simultaneously generated and moved by introducing a phase delay into the radiated wave front. Such an antenna, moreover, is called a phased array. One illustrative example of such a system is shown and disclosed in U.S. Pat. No. 4,028,710, entitled, "Apparatus For Steering A Rectangular Array . . . " which issued to G. E. Evans, the present inventor, on June 7, 1977.

The Butler matrix, moreover, since its inception has found wide applicability in the formation of such beams. A Butler matrix is well documented in the prior art and typically comprises a network of 3-db directional couplers and fixed phase shifters where the directional couplers are comprised of four port power dividers having the property of providing two outputs differing in phase by 90°, or conversely, of coupling all power to one of two isolated ports when power is applied equally to two other ports with a 90° phase differential. Illustrative examples of this type of beam forming matrix, moreover, are shown and disclosed in U.S. Pat. No. 3,255,450, entitled, "Multiple Beam Antenna System Employing Multiple Directional Couplers In The Leadin", which issued to J. L. Butler on June 7, 1966, and U.S. Pat. No. 3,295,134, entitled, "Antenna System For Radiating Directional Patterns", which issued to W. R. Lowe on Dec. 27, 1966.

A Butler matrix, however, has an inherent limitation in that it comprises a binary network in that it can only be used for a binary number ($2^n$) of antenna elements. All of the $2^n$ outputs of the matrix are fed equally from the same number of $2^n$ inputs with a linear phase front. Each phase front has a different slope across the outputs which change in steps of $2\pi/2^n$ radians per element.

Where there is a requirement for other than a binary number of outputs, a suitable beam forming matrix can be developed but prior art design techniques require the utilization of a network which becomes relatively complex and physically awkward to implement in comparison to a binary matrix system. A typical example of non-binary matrix is shown and disclosed in U.S. Pat. No. 4,231,040, entitled, "Simultaneous Multiple Beam Antenna Array Matrix And Method Thereof", which issued to S. H. Walker on Oct. 28, 1980. The problem of designing a simple and efficient matrix becomes particularly difficult where less than the number of available beams are used and the desired beams result from a selected number of beams which are necessarily generated by a non-binary matrix. Such a situation exists, for example, where only a small sector of a total elevation region is utilized.

Accordingly, it is an object of this invention to provide an improved network for forming multiple beams in an antenna array.

It is another object of the invention to provide a simplified network for forming a set of orthogonal beams from a phased array.

A further object is to provide an antenna system whereby a binary beam forming matrix is expanded in such a manner that it is capable of being used in conjunction with a non-binary number of antenna elements.

And still a further object of the invention is to provide a simplified network whereby a binary matrix is transformed into a non-binary matrix for forming a plurality of component beams which are utilized to construct relatively larger composite beams having reduced side lobes.

SUMMARY OF THE INVENTION

Briefly, the foregoing and other objects of the invention are provided by a method and apparatus wherein a binary Butler matrix is coupled to a non-binary number of antenna elements and more particularly where it comprises the expansion of an $n \times n$ binary matrix into a non-binary $n \times (n+l)$ matrix coupled to $n+l$ elements, where l is equal to the additional number of elements not greater than the binary number n. Moreover, the inventive concept is based upon the fact that the phase required outside of the n elements normally fed by the n output ports of an $n \times n$ Butler matrix is a repeat of the phase shift on the opposite side of the n elements except for a fixed 180° phase shift and accordingly the 1st and $(n+1)_{th}$ element to the right of the $n_{th}$ element are coupled to a common first port of the matrix with the exception that the $(n+1)_{th}$ element is coupled thereto through a 180° fixed phase shifter. In the same fashion, the $0_{th}$ element to the left of the 1st element of n elements is fed from the same or last ($n_{th}$) output port feeding the $n_{th}$ element with the exception that it is also coupled thereto by means of a respective 180° fixed phase shifter. Similarly, each successive element on either side of the n elements are coupled to a respective ascending or descending numbered port, as the case may be, but being coupled thereto via a 180° phase shifter. Such an arrangement provides a taper across the beam component due to the power split but since the components are desired to be used subsequently to form tapered beams, a partial result is already provided thereby.

DESCRIPTION OF THE PREFERRED EMBODIMENT

Figure 1:
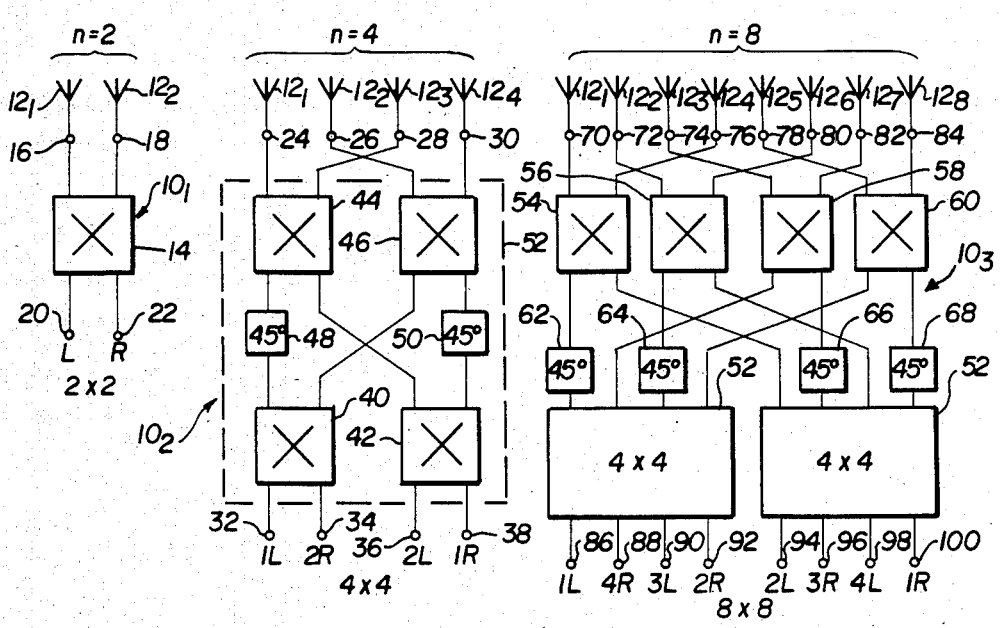
FIG. 1 PRIOR ART
FIG. 1 is a set of electrical diagrams illustrative of standard binary Butler matrices and which constitutes known prior art.

Referring now to the drawings and more particularly to FIG. 1, shown thereat are three phased array antenna array matrices $\mathbf{10}_1$, $\mathbf{10}_2$ and $\mathbf{10}_3$ for simultaneously providing multiple orthogonal beams. These matrices comprise well known binary Butler matrices coupled to a plurality ($n=2^m$) antenna elements $\mathbf{12}_1 \ldots \mathbf{12}_n$. The simplest Butler matrix comprises a single 3-db quadrature coupler 14 which supplies signals at the output ports 16 and 18 that are mutually 90° out of phase for power applied to either input port 20 and 22. Power is split approximately equally between the two output ports. Where, for example, input port 20 is designated the left input port, while the other input port 22 is designated the right input port, power which is supplied to the left input port 20 will appear at the output port 16 lagging in phase by 90°, i.e., ∠−90° while power appears at the other output port 18 lagging in phase by 180°, i.e., ∠−180°. Two orthogonal beams accordingly appear at the antenna elements $12_1$ and $12_2$ having a progressive phase front with the beam emanating from antenna $12_2$ lagging the beam from antenna $12_1$ by 90°, thereby forming a wavefront which is directed to the right. On the other hand, applying power to the right input port 22 causes the power to be split between the output ports 16 and 18 such that the power at output port 18 now lags in phase by 90°, whereas power at output port 16 lags by 180° and accordingly a progressive phase front directed toward the left is generated.

Such an arrangement, moreover, is reciprocal in that power transfer will be the same for both transmission and reception and accordingly where an incident phase front is directed to the antennas $12_1$ and $12_2$ from the right RF energy arrives first at antenna $12_2$ and then $12_1$. Where a progressive phase front difference of exactly 90° exists, all of the received signal will appear at the left port 20 whereas an identical wave arriving from the left causes all of the received signal to appear at the right port 22. This operation is well known and forms the basis by which all Butler matrix phased array antenna systems are based.

While the matrix $10_1$ comprises what is referred to as a 2×2 Butler matrix, the matrix $10_2$ shown in FIG. 1 comprises a binary ($2^2=4$) Butler matrix having four output ports 24, 26, 28 and 30 which respectively couple to four antenna elements $12_1$, $12_2$, $12_3$ and $12_4$ and four input ports 32, 34, 36 and 38. The matrix $10_2$ thus comprises a 4×4 matrix and is further comprised of four cross-coupled 3-db couplers 40, 42, 44 and 46 and two 45° fixed phase shifters 48 and 50. Such an arrangement constitutes a four beam forming network which can be considered as being comprised of two 2-beam matrices consisting of, for example, the two couplers 40 and 42 which are interlaced and then providing a second level of directional couplers consisting of the couplers 44 and 46 to combine the outputs into beams. Two fixed phase shifters 48 and 50 are necessary in two of the signal legs between the upper and lower levels of couplers to form the output beam. This technique is well known and is furthermore shown and described in the above referenced U.S. Pat. No. 3,295,134, W. R. Lowe.

With the combination of the couplers 40, 42, 44, 46 and phase shifters 48 and 50 being further identified by reference numeral 52, the same configuration can be utilized to implement a next larger ($2^3=8$) i.e. 8×8 binary Butler matrix $10_3$ of FIG. 1. There two 4×4 binary matrices 52 are interlaced to a third level of four 3-db couplers 54, 56, 58 and 60 through four 45° fixed phase shifters 62, 64, 66 and 68. Provided thereby are eight output ports 70, 72, 74 . . . 84 respectively coupled to antenna elements $12_1 \ldots 12_8$ and eight input ports 86, 88 . . . 100. While the four beam matrix $10_2$ of FIG. 1 can be considered to form two beams 1R and 2R on the right hand side of the center axis of the array between elements $12_2$ and $12_3$ and two beams 1L and 2L on the left side of the axis of the array, the eight beam matrix $10_3$ forms four beams 1R, 2R, 3R and 4R on the right hand side of the center axis of the array between elements $12_4$ and $12_5$ and four beams 1L, 2L, 3L and 4L on the other side of the center axis correspond to the designated ports 86 through 100 shown in FIG. 1.

Figure 2:
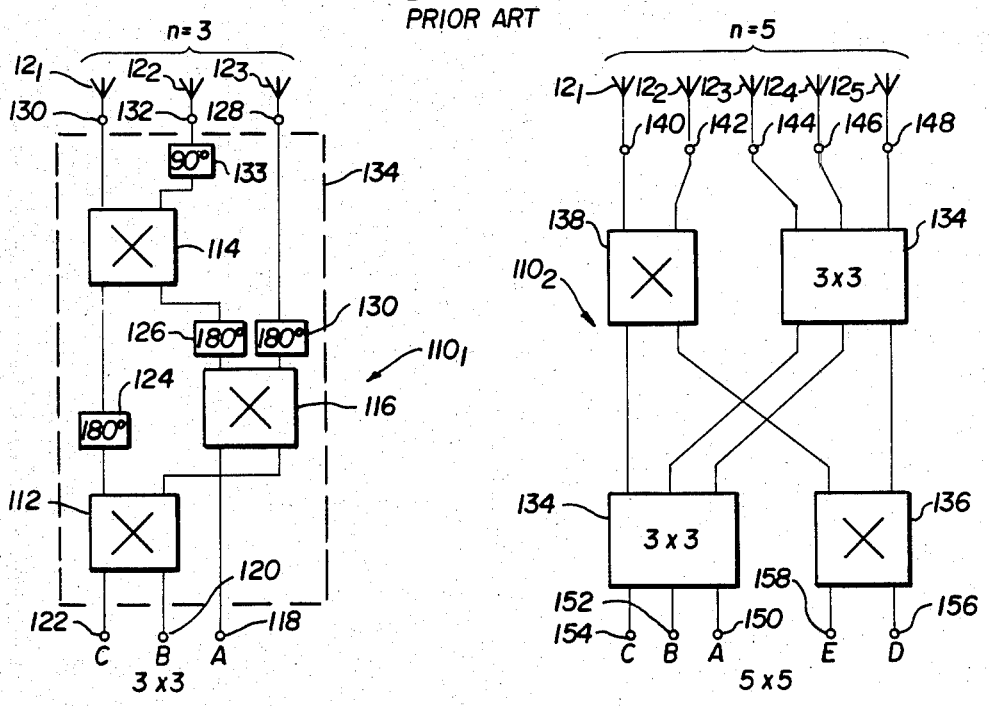
FIG. 2 PRIOR ART
FIG. 2 is a set of electrical block diagrams illustrative of non-binary matrices and which also constitutes known prior art.

In an effort to develop feeds for a non-binary number of antenna elements, the prior art has resorted to non-binary matrices as shown in FIG. 2 wherein reference numerals $110_1$ and $110_2$ disclose non-binary 3×3 and 5×5 matrices, respectively. Considering first the matrix $110_1$, n=3 orthogonal beams are formed by a combination of two 3-db couplers 112 and 114 and a single 4.8-db coupler 116. One of the input ports of the 4.8-db couplers 116 forms one input port 118 for beam A while the two input ports of 3-db coupler 112 form the other two input ports 120 and 122 for the beams B and C. One output port of the 3-db coupler 112 cross couples to the other input port of the 4.8-db coupler 116 while the other output port couples to one input port of the 3-db coupler 114 through 180° fixed phase shifter 124. One output port of the 4.8-db coupler 116 couples to the other input of the 3-db coupler 114 through a 180° fixed phase shifter 126 while the other output port of the 4.8-db coupler couples to one matrix output port 128 through a 180° fixed phase shifter 130. A second matrix output port 130 is directly coupled to one output port of the 3-db coupler 114 while the third matrix output port 132 couples to the other output port of the 3-db coupler 114 through a 90° fixed phase shifter 133. It can be seen then that a non-binary matrix requires a combination of different elements, particularly the couplers, which by their very nature lends itself to a relatively complex physical arrangement, particularly where a stripline configuration is desired to be implemented.

Where the configuration of the couplers and fixed phase shifters shown by reference numeral $110_1$ can be represented simply by reference numeral 134, a pair of these 3×3 matrices can be interlaced together with two four port directional couplers 136 and 138 to provide a 5×5 matrix having five output ports 140, 142 . . . 148 which are respectfully connected to antenna elements $12_1$ $12_2 \ldots 12_5$ and five input ports 150, 152 . . . 158. These ports also correspond to five orthogonal beams A, B, C, D and E.

Typically, the beams from the matrices shown in FIGS. 1 and 2 comprise sin x/x beams which are used to form larger beams having reduced sidelobes which implies an amplitude taper providing a cosine distribution. If the antenna elements are desired to be driven at reduced power, one can take advantage of this in the matrix. This now leads to a consideration of the subject invention. Where a non-binary number of outputs is required, the present invention has for its purpose the expansion of a binary matrix such that it provides a non-binary number of output ports while having a binary number of input ports.

Figure 3:
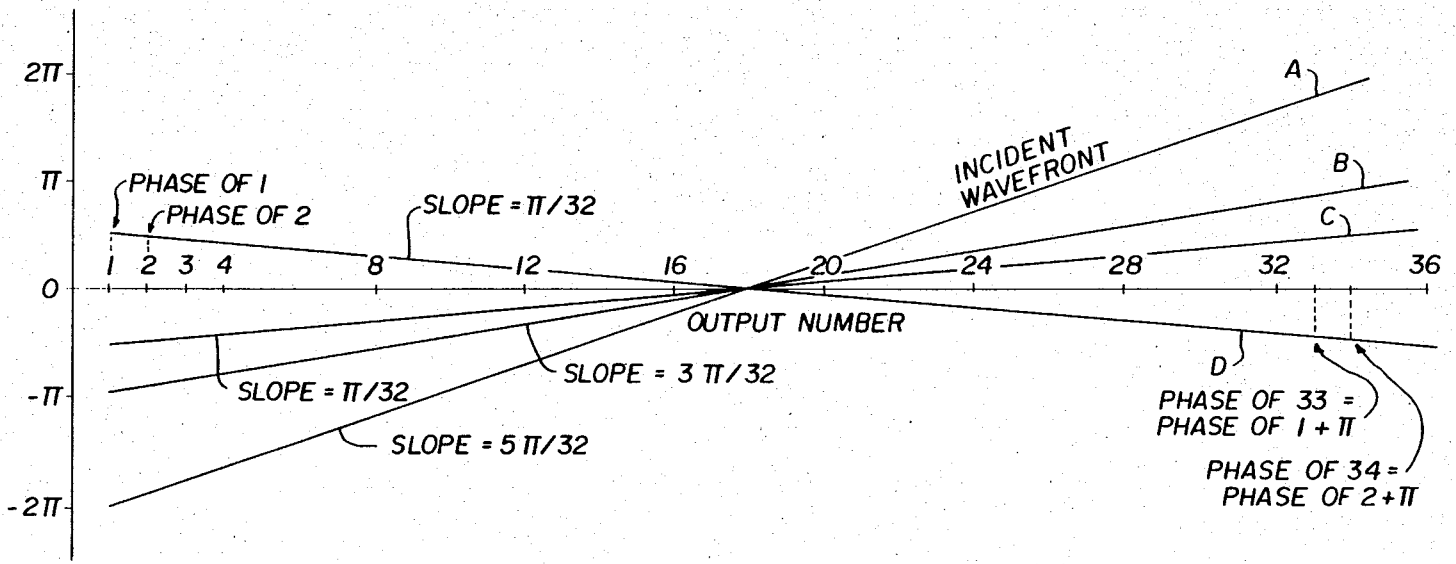
FIG. 3 is a phase output diagram of a matrix in accordance with the subject invention.

Referring now to FIG. 3, there is disclosed a diagram illustrative of the respective phases for the elements of a phased array for four incident wavefronts A, B, C and D. Assuming, for example, that the number of elements or outputs is greater than the binary number $2^5=32$ and it is desired to employ a 32×32 matrix which is binary, an observation of the wavefront shown in FIG. 3 relative to the number of the output reveals that the phases required on either side of the 32 elements is the same except for 180° phase shift. By this is meant element 33, for example, has the same phase as element 1 except for a phase shift of $\pi$ or 180°. Likewise, the phase required for element 34 is the same as for element 2 plus 180°. Therefore, if one were to couple power from the output port coupled to element 1 to element 33 through a 180° fixed phase shift, a correct phase would be provided. Similarly, power coupled from the output port driving element 32 could be coupled to the first element on the left of element 1, defined as element 0, if it additionally includes 180° phase shift. Thus, for example, two elements could be driven on each side of an n=32 output matrix simply by the addition of four couplers and four 180° phase shifters or simply four couplers alone if they inherently include a 180° phase shift and thus there would be provided a 36 element non-binary aperture while utilizing an expansion of a 32×32 binary matrix. The result of such an arrangement is a tapered distribution, occurring due to the splitting of power provided by the couplers; however, the amount of taper is determined by the number of additional elements being coupled to the binary matrix.

Figure 4:
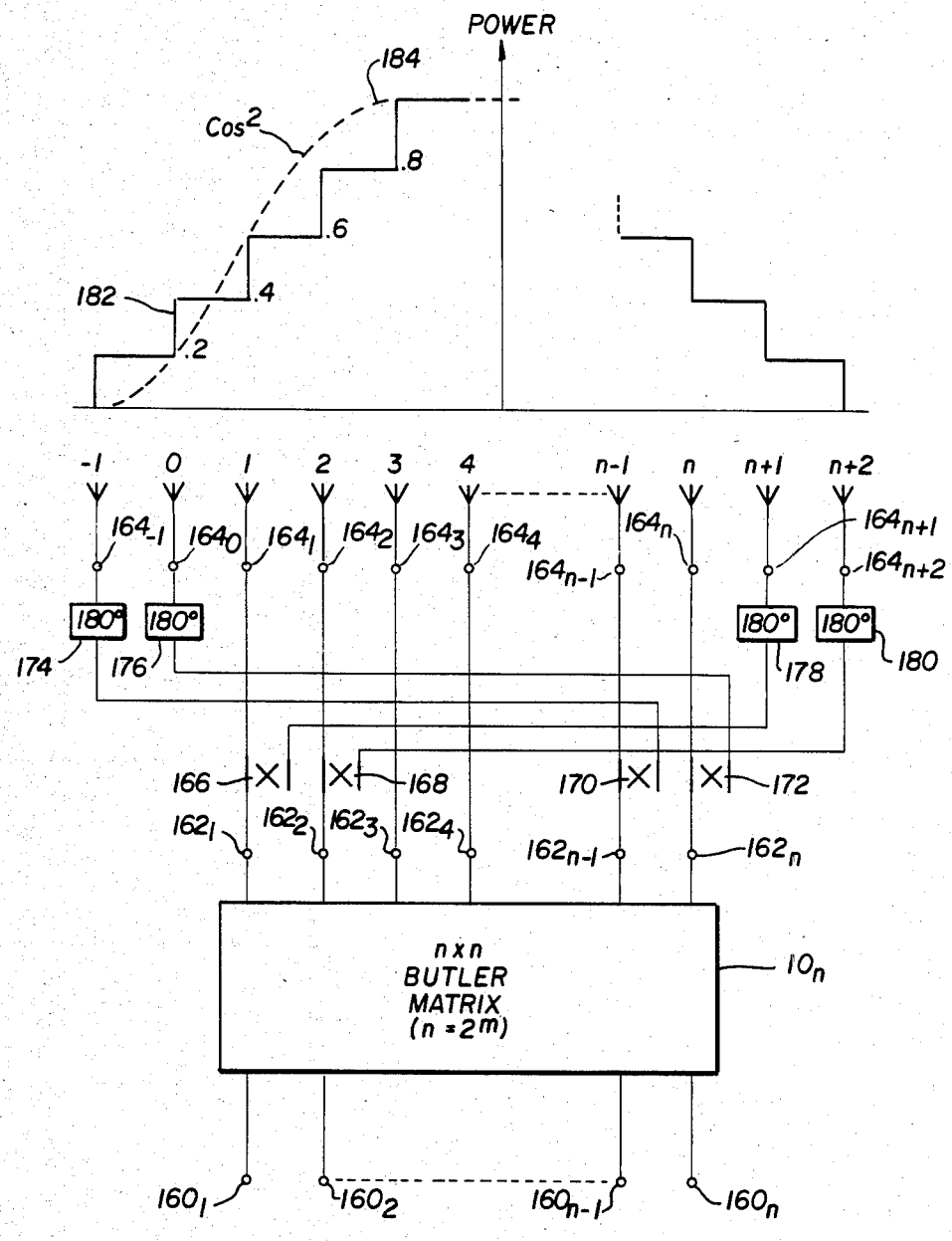
FIG. 4 is an electrical block diagram illustrative of the preferred embodiment of the invention together with a power distribution curve therefor.

Accordingly and now referring to FIG. 4, a non-binary number of n+1 antenna elements designated by the reference numerals −1, 0, 1, . . . n, n+1, and n+2 can be coupled to a binary n×n Butler matrix $\mathbf{10}_n$, having n input ports $\mathbf{160}_1$, $\mathbf{160}_2$ . . . $\mathbf{160}_n$ and n output ports $\mathbf{162}_1$, $\mathbf{162}_2$ . . . $\mathbf{162}_n$ by means of an expansion network including n+1 additional ports $\mathbf{164}_{-1}$, $\mathbf{164}_0$, $\mathbf{164}_1$ . . . $\mathbf{164}_n$, $\mathbf{164}_{n+1}$ and $\mathbf{164}_{n+2}$ respectively coupled to the n+1 antenna elements, four signal couplers 166, 168, 170 and 172 and four 180° fixed phase shifters 174, 176, 178 and 180. Further, as shown, antenna element No. 1 and the $n(n+1)_{th}$ element to the right of the $n_{th}$ element are coupled to a common matrix output port, namely port $\mathbf{162}_1$ of the binary matrix $\mathbf{10}_n$ with the exception that the $(n+1)_{th}$ element is coupled thereto through the coupler 166, 180° fixed phase shifter 178 and the additional port $\mathbf{164}_{n+1}$. Element No. 2 and $(n+2)_{th}$ element to the right of the $n_{th}$ element are coupled to a common output port $\mathbf{162}_2$ of the matrix $\mathbf{10}_n$ through the coupler 168, 180° fixed phase shifter 180 and the additional port $\mathbf{164}_{n+2}$. If the couplers 166 and 168 are designed to provide 180° phase shift, the individual 180° fixed phase shifters 178 and 180 may be deleted. Typically, however, the phase shifters are comprised of distributed phase shifters in the form of stripline components. In a like manner, the antenna elements Nos. 0 and −1 to the left of element 1 of the array are coupled to the matrix output ports $\mathbf{162}_n$ and $\mathbf{162}_{n-1}$ feeding the respective $n_{th}$ and $n-1_{th}$ elements with the exception that 180° phase shift is again provided. As shown in FIG. 4, this comprises the signal couplers 172 and 170 connected to the $\mathbf{0}_{th}$ and the $-\mathbf{1}_{st}$ elements through fixed phase shifters 176 and 174 and the respective additional ports $\mathbf{164}_0$ and $\mathbf{164}_{-1}$. Although now shown, additional elements can be included, when desired, with each successive element on either side of the n elements being coupled to respective ascending or descending numbered output ports, as the case may be, but having the required 180° phase shift.

The configuration of FIG. 4 provides a tapered distribution of power as evidenced by the stepped distribution curve 182 which can be made to approximate a $\cos^2$ curve 184. This type of beam forming network has limited application due to the fact that there no longer is a complete set of orthogonal beam components available. Moreover, the beams are slightly narrower than their spacing so that beams midway between components are harder to form. Moreover, carried to extremes, a n×n matrix could feed 2n elements with a cosine taper, however, every other cosine beam would be missing.

Thus what has been shown and described is a means for utilizing a binary Butler matrix to drive a non-binary number of elements with only a few added couplers and phase shifters where the couplers themselves do not provide the necessary phase shift. This adds a taper across the beam components but since the components are subsequently used to form tapered beams in any event, the impact is small.

While there has been shown and described what is at present considered to be the preferred method and embodiment of the invention, it should be noted that the foregoing has been made by way of illustration and not limitation. Accordingly, all modifications, alterations and changes coming within the spirit and scope of the invention as defined in the appended claims are herein meant to be included.

I claim:

1. A method of expanding an orthogonal beam forming matrix, having a first plurality of antenna elements ports, into a matrix having a second plurality of ports, said second plurality of ports being coupled to a respective number of antenna elements greater in number than said first plurality of ports, comprising the steps of:

isophase coupling said first plurality of ports to a like number of respectively positioned ports of said second plurality of ports;

coupling at least one port of said first plurality of ports to a corresponding numbered additional port of said second plurality of ports adjacent the isophase coupled ports; and effecting an additional 180° phase shift of signals coupled between said at least one port and said additional port.

2. The method as defined by claim 1 wherein said matrix having said first plurality of ports comprises a binary matrix.

3. The method as defined by claim 1 wherein said matrix having said first plurality of ports comprises an n×n binary matrix having $2^m$ input ports and $2^m$ output ports and where m is an integer.

4. The method as defined by claim 1 wherein said matrix comprises a Butler matrix having $n=2^m$ output ports and wherein said antenna elements comprise n+1 antenna elements and where n+1 is a non-binary number.

5. The method as defined by claim 1 wherein said at least one port comprises the first of said first plurality of ports and said additional port comprises a port of said second plurality of ports immediately adjacent the last of said isophase coupled ports.

6. The method as defined by claim 5 and additionally including the steps of:

coupling a selected number of other ports of said first plurality of ports to other corresponding ports of said second plurality of ports in ascending and descending order on the other side of said isophase coupled ports; and effecting an additional respective 180° phase shift of signals coupled between each of said other ports of said first plurality of ports and said other additional ports of said second plurality of ports.

7. The method as defined by claim 1 wherein said at least one port comprises the last of said first plurality of ports and said additional port commprises a port of said second plurality of ports immediately adjacent the first of said isophase coupled ports.

8. The method as defined by claim 7 and additionally including the steps of:

coupling a selected number of other ports of said first plurality of ports to other corresponding numbered ports of said second plurality of ports in ascending and descending order on the other side of said isophase coupled ports; and effecting respective additional 180° phase shifts of signals coupled between each of said other ports of said first plurality of ports and said other additional ports of said second plurality of ports.

9. A method of expanding an orthogonal beam forming matrix comprising a binary ($n=2^m$) Butler matrix having n input ports and n output ports into a non-binary matrix having n+1 output ports coupled to a respective number of n+1 antenna elements and where $1 \leqq n$, comprising the steps of:

isophase coupling the n output ports of the Butler matrix to n ports of the n+1 output ports;

coupling the 1st output port of said n output ports to the $(n+1)_{th}$ port of said n+1 output ports to the right of the $n_{th}$ port thereof and effecting an additional 180° phase shift of signals therebetween.

10. The method of claim 9 and additionally including the steps of coupling selected numbers of other l output ports of said n+1 output ports on either side of said n output ports thereof, comprising ports 1 through n, to respective ascending and descending ports of said n output ports of said Butler matrix and effecting an additional respective 180° phase shift of signals therebetween.

11. Apparatus for expanding an orthogonal beam forming matrix, having first plurality of output ports normally coupled to antenna elements, into a matrix having a second plurality of output ports coupled to a respective number of antenna elements greater in number than said first plurality of output ports, comprising:

means isophase coupling said first plurality of output ports to a like number of respectively positioned ports of said second plurality of ports;

means coupling at least one port of said first plurality of ports to a like numbered additional output port of said second plurality of output ports adjacent said isophase coupled ports; and means providing an additional 180° phase shift of signals coupled between said at least one output port of said first plurality of ports and said additional output port of said second plurality of ports.

12. The apparatus as defined by claim 11 wherein said at least one port selectively comprises the first or last of said first plurality of ports and said additional port comprises a port of said second plurality of ports on the other side immediately adjacent the last or first of said isophase coupled ports, respectively.

13. The apparatus as defined by claim 11 and additionally including, means coupling a selected number of other ports of said first plurality of output ports to predetermined other additional output ports of said second plurality of ports outside of said isophase coupled ports; and means providing a respective additional 180° phase shift of signals coupled between each of said other ports of said first plurality of ports and said other additional ports of said second plurality of ports.

14. The apparatus as defined by claim 13 wherein said other additional output ports of said second plurality of ports comprise like numbered ports on the other side of said isophase coupled ports.

15. The apparatus as defined by claim 11 and additionally including, means coupling progressively increasing predetermined ones of additional output ports of said second plurality of ports on either side of said isophase coupled ports to respective ascending and descending numbered ports of said first plurality of output ports, and means providing respective additional 180° phase shifts of signals coupled therebetween.

16. The apparatus as defined by claim 11 wherein said matrix having said first plurality of output ports comprises a binary matrix.

17. The apparatus as defined by claim 11 wherein said matrix having said first plurality of output ports comprises an $n \times n$ binary matrix having $2^m$ input ports and $2^m$ output ports and where m is an integer.

18. The apparatus as defined by claim 11 wherein said matrix having said first plurality of output ports comprises a Butler matrix having $n=2^m$ output ports, wherein said antenna elements comprise n+1 antenna elements and where m is a selected whole number and n+1 is a non-binary whole number.

19. An orthogonal beam forming network for a phased array antenna including n+1 antenna elements comprising:

a binary $n \times n$ matrix having n input ports and n output ports, said n output ports being isophase coupled to n elements of said n+1 antenna elements and where $1 \leqq n$;

means additionally coupling the 1st output port of said n output ports of said binary matrix to the $(n+1)_{th}$ antenna element to the right of the $n_{th}$ antenna element and including means providing an additional 180° phase shift of signals therebetween; and means additionally coupling the $n_{th}$ output port of said n output ports of said binary matrix to the $0_{th}$ antenna element to the left of the 1st antenna element and including means providing an additional 180° phase shift of signals therebetween, whereby said binary matrix is transformed into a non-binary matrix.

20. The beam forming network of claim 19 and additionally including means coupling selected other ones of said l antenna elements on either side of said isophase coupled ports and said n antenna elements to ascending and descending numbered ports of said n output ports of said binary matrix and including means providing respective additional 180° phase shift of signals therebetween.

* * * * *